US006490906B1

(12) United States Patent
Bailey

(10) Patent No.: US 6,490,906 B1
(45) Date of Patent: Dec. 10, 2002

(54) VEHICLE BODY REPAIR TOOL

(76) Inventor: Rick H. Bailey, 1000 Ubly Rd., Bad Axe, MI (US) 48413

( * ) Notice: Subject to any disclaimer, the term of this patent is extended or adjusted under 35 U.S.C. 154(b) by 0 days.

(21) Appl. No.: 09/798,231

(22) Filed: Mar. 2, 2001

(51) Int. Cl.[7] ..... B21J 13/08
(52) U.S. Cl. ..... 72/457; 72/447; 72/705
(58) Field of Search ..... 72/457, 705, 446, 72/447

(56) References Cited

U.S. PATENT DOCUMENTS

| | | | | | |
|---|---|---|---|---|---|
| 4,158,303 | A | * | 6/1979 | Horn et al. | 72/705 |
| 4,190,233 | A | | 2/1980 | Godfrey | |
| 4,475,716 | A | * | 10/1984 | Jarmin et al. | 72/705 |
| 4,530,492 | A | | 7/1985 | Bork | |
| 4,555,927 | A | * | 12/1985 | Grace | 72/705 |
| 4,848,132 | A | * | 7/1989 | Saroli | 72/705 |
| 4,898,018 | A | * | 2/1990 | Ventress | 72/705 |
| 4,932,639 | A | | 6/1990 | Fjellstrom | |
| 5,135,205 | A | | 8/1992 | Bedard | |
| 5,269,501 | A | | 12/1993 | Liegel et al. | |
| 5,549,287 | A | | 8/1996 | Loucks | |
| 5,662,315 | A | | 9/1997 | Neiss et al. | |
| 5,839,876 | A | | 11/1998 | McCarthy et al. | |
| 5,862,885 | A | | 1/1999 | Carmitchel | |
| 5,863,034 | A | | 1/1999 | Vauter | |

* cited by examiner

*Primary Examiner*—Ed Tolan
(74) *Attorney, Agent, or Firm*—Reising, Ethington, Barnes, Kisselle, Learman & McCulloch, P.C.

(57) ABSTRACT

The carriage has a main frame supported by caster wheels. A vertical mast is connected to a mounting stud on the main frame. A tubular sleeve is slideably mounted on the vertical mast and held in fixed positions by a pin. A winch fixed to the tubular sleeve has a winch cable that extends over a roller on top of the mast and has a hook that engages the sleeve to raise and lower the sleeve. A mounting stud on the sleeve receives an accessory base or cable guide pulley accessory. The accessory base receives adjustable attachments for supporting vehicle components such as doors, hoods, bumpers and trunk lids. The cable guide pulley guides the winch cable to pull dented sheet metal vertically or horizontally. The carriage is anchored in place, when pulling dented sheet metal, by a retainer.

23 Claims, 9 Drawing Sheets

102
98
100
94
92
90
86
64
70
60
224
182
188
186
144
183
33
226
145
148
222
34
147
10
72
116
146
76
228
89
66
112
68
196
62
133
126
18
26
12
105
32
24
270
22

VEHICLE BODY REPAIR TOOL

TECHNICAL FIELD

The vehicle body repair tool is a multi-function tool for use while removing dents as well as removing and replacing vehicle body components.

BACKGROUND OF THE INVENTION

Large frames are available which secure a vehicle body and pull on the body in various locations to substantially return the body to its original dimensions. Such frames are expensive, require substantial floor space in a building and have limited use.

Numerous tools for holding individual body parts are available. There are for example vehicle door jacks and transporters which hold and support a vehicle door while it is removed from a vehicle or reattached to a vehicle. There are also bumper jacks that hold a bumper while it is removed from or attached to a vehicle. These jacks for doors and bumpers are often employed due to the weight of doors and bumpers. Doors tend to be heavy due to side impact protective beams, glass, power window openers, and rear view mirrors. Bumpers tend to be heavy due to energy absorption devices and government regulations relating to bumper damage. Without the jacks mounted on wheels, three people may be required to reattach a door or a bumper to a vehicle.

Hoods and trunk lids are generally lighter than doors. However their size can make them difficult to handle. Three people should be used to mount a hood or a trunk lid on a vehicle to reduce the danger of damage to the vehicle as well as to the hood or trunk lid.

The use of dedicated tools for mounting doors, bumpers, hoods and trunk lids requires a large tool storage area. Each of the tools requires a dedicated jack or other lifting and supporting device thereby adding substantial cost when two or more tools are required.

SUMMARY OF THE INVENTION

The vehicle body repair tool includes a carriage having a main frame. A plurality of wheels are attached to and support the main frame. A mast mounting structure is provided on the main frame. A mast is connected to the mast mounting structure and extends generally vertically upward from the carriage. A first tubular sleeve is slideably mounted on the mast and is vertically movable relative to the mast. A winch assembly is fixed to the first tubular sleeve. An accessory mount is provided on the first tubular sleeve. A mast roller is mounted on top of the mast. A winch cable extends upward over the mast roller and has an end hook that is connectable to the first tubular sleeve. The winch assembly is operable to move the first tubular sleeve vertically along the mast. A first sleeve retainer holds the first tubular sleeve in a selected vertical position on the mast and frees the winch cable and end hook. An accessory is attached to the accessory mount on the first tubular sleeve.

The accessory attached to the accessory mount can be a vehicle hood support and holder, a vehicle bumper holder or a vehicle door holder. All of these holders have a vertically adjustable member and a horizontally adjustable member connected to the first tubular sleeve.

The accessory attached to the accessory mount can also be a cable guide pulley holder. The cable guide pulley holder can position the free end of the winch cable to exert a generally horizontal force on a vehicle body. The cable guide pulley holder may also position the free end of the winch cable to exert a generally vertical force on a vehicle body. When exerting a vertical or horizontal force on a vehicle body, the carriage is anchored in place by a retainer with an outside tubular member that is anchored by the weight of the vehicle.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 2:
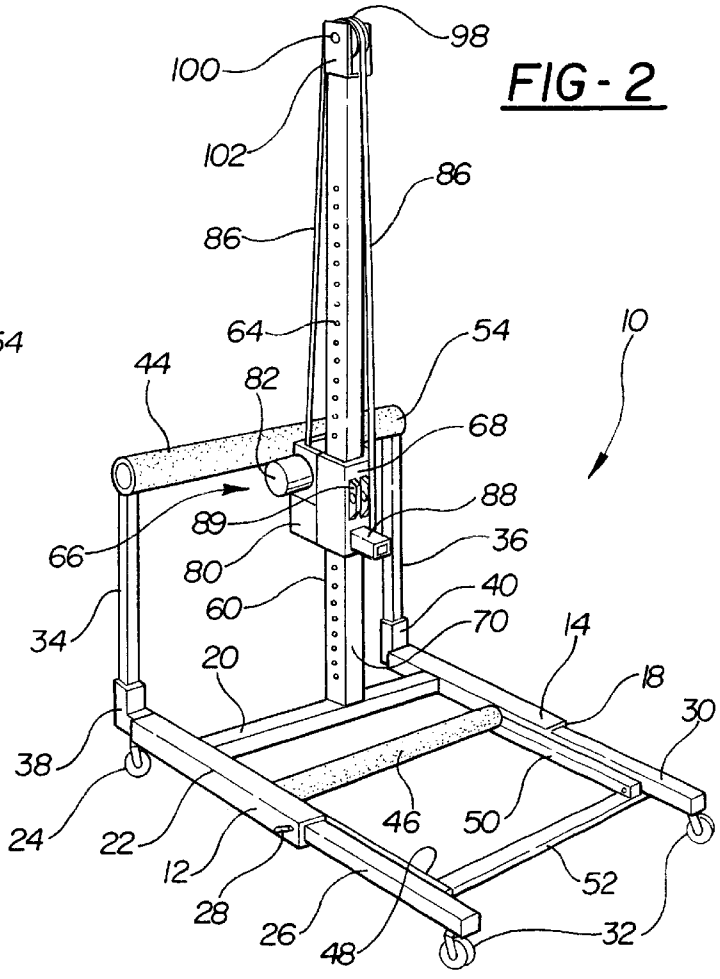
FIG. 2 is a perspective view of the carriage with a mast attached.

The carriage 10 has a first side beam 12 that is a square tube. A second side beam 14 is parallel to and identical to the first side beam 12. The first and second side beams 12 and 14 have a rear end 16 and a front end 18. A transverse base beam 20 is welded to the first side beam 12 and the second side beam 14 to form an H-shaped main frame 22. The base beam 20 is spaced a short distance from the rear end 16 and a longer distance from the front end 18.

Caster wheels 24 support the rear ends 16 of the first and second side beams 12 and 14. A first rectangular main frame support tube 26 is telescopically received in the front end 18 of the first side beam 12 and locked in a selected position by a threaded T-clamp 28. A second rectangular main frame support tube 30 is telescopically received in the front end 18 of the second side beam 14 and locked in a selected position by a threaded T-clamp 28. The front caster wheels 32 are attached to the free ends of the first and second rectangular main frame support tubes 26 and 30 and support the H-shaped main frame 22 in a-substantially horizontal position.

A rear handle 33 has two rear uprights 34 and 36 that are connected to L-shaped brackets 38 and 40 that are telescopically received in their rear ends 16 of the H-shaped main frame 22 and clamped in place by threaded T-clamps 42. A cross bar with a padded cover 44 is welded to the upper ends of the uprights 34 and 36.

Figure 1:
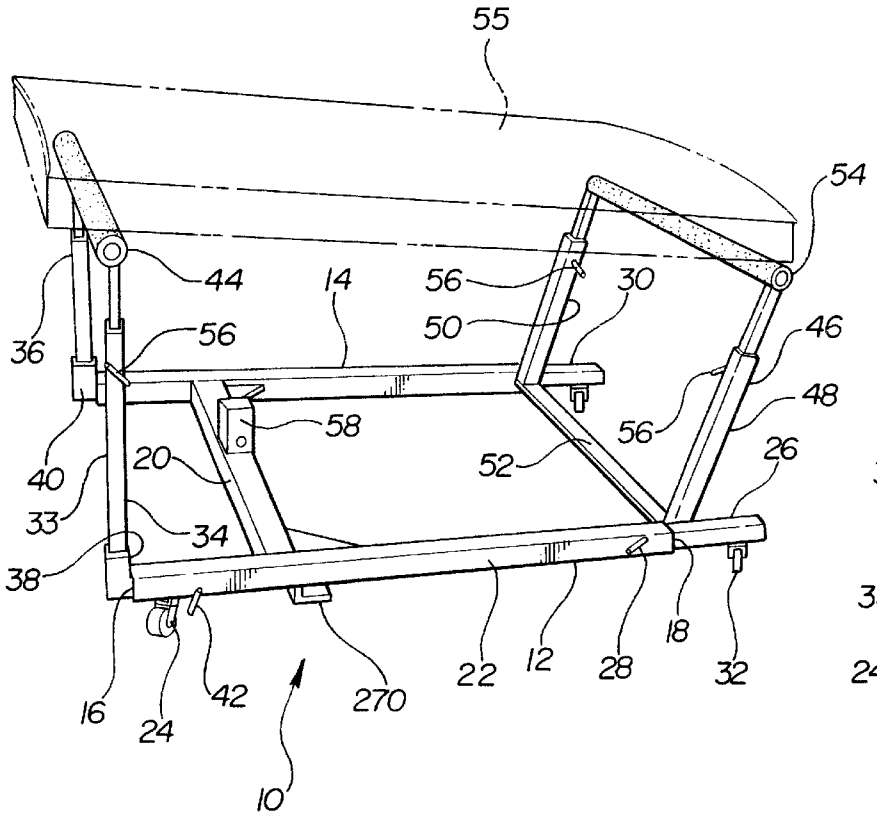
FIG. 1 is a perspective view of the carriage supporting a vehicle door for repair.
Figure 3:
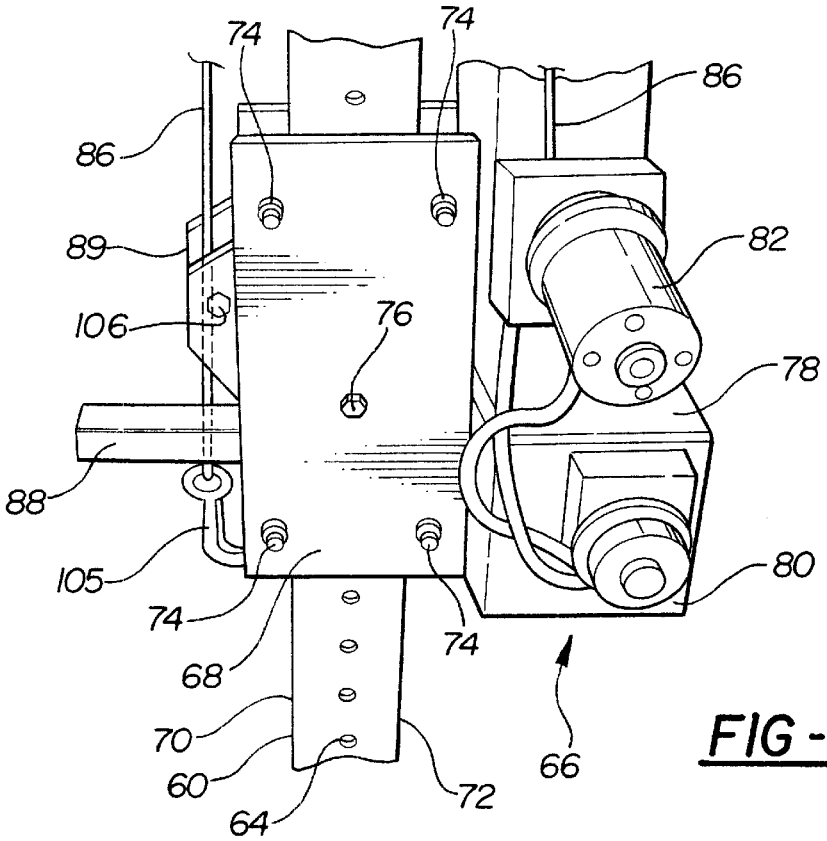
FIG. 3 is an enlarged perspective view of a portion of the mast and the winch assembly.
Figure 4:
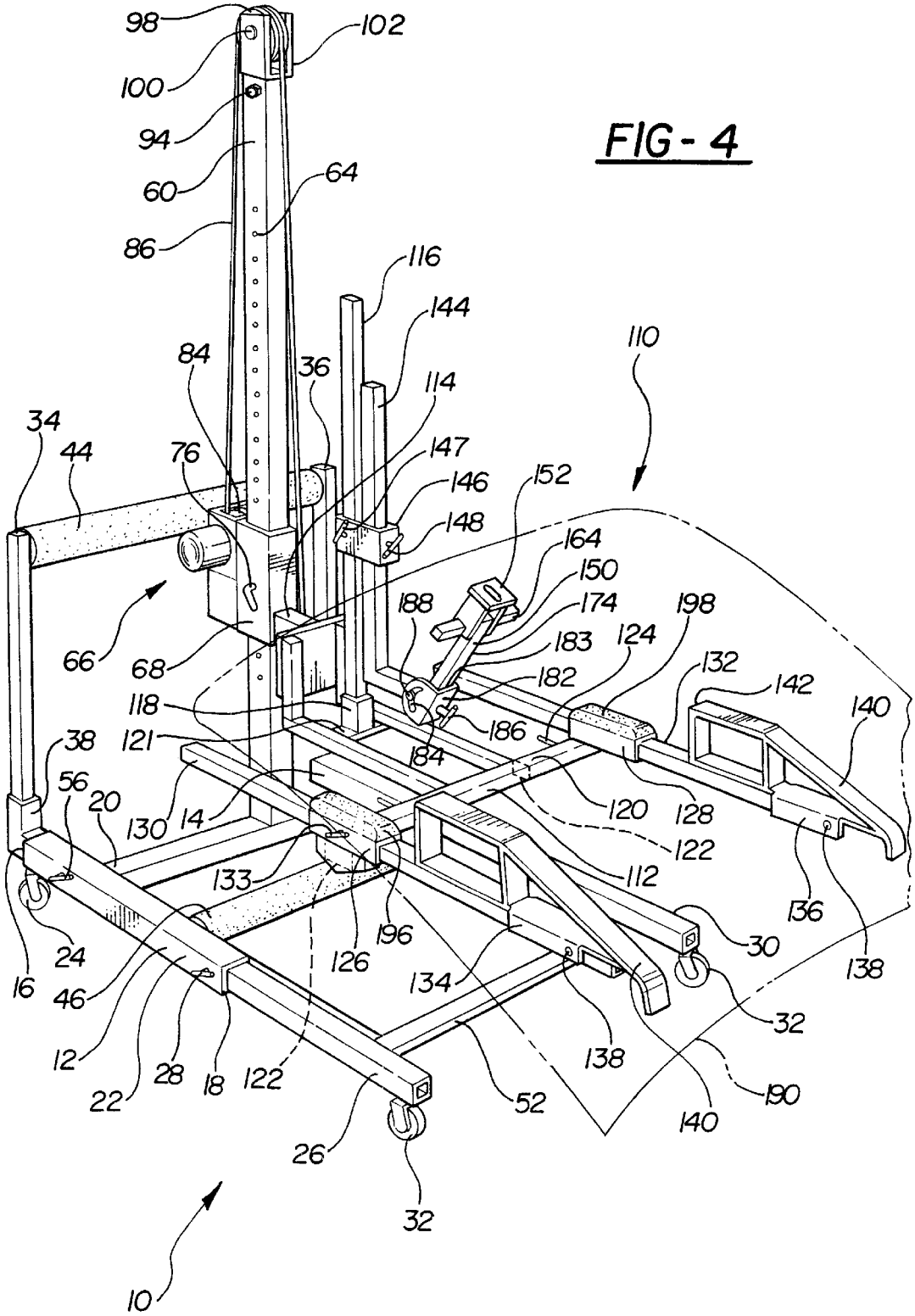
FIG. 4 is a perspective view of the carriage with a mast and a hood supporting attachment.

A front handle 46, shown in a storage position in FIG. 4, has two uprights 48 and 50 that are welded to a bottom cross bar 52 and to an upper cross bar with a padded cover 54. The bottom cross bar 52 is pivotally attached to the H-shaped main frame 22. When the front handle 46 is in a generally vertical position as shown in FIG. 1, the rear handle 33 and the front handle 46 cooperate to form a workpiece holder for a workpiece such a vehicle door 55 shown in phantom lines. The uprights 34 and 36 as well as the uprights 48 and 50 can have adjustable length with threaded T-clamp bolts 56 for adjusting the height of the door 55 as shown in FIG. 1.

A mast mounting stud 58 is welded to the center of the transverse base beam 20. A vertical tubular mast 60 telescopically receives the mast mounting stud 58 and is held in place by a bolt 62. A plurality of transverse bores 64 are drilled through the mast 60 and are spaced apart vertically a uniform distance.

A winch assembly 66 includes a tubular sleeve 68 that telescopically receives the mast 60. Bearings are mounted inside the sleeve 68 to reduce friction between the sleeve and the front mast surface 70 and the rear mast surface 72. The bearing can be roller assemblies 74 or low friction shoe members. A pin 76 passes through a bore through the sleeve 68 and a selected one of the transverse bores 64 through the mast 60 to selectively set the vertical position of the winch assembly 66 on the mast 60. A battery 78 is held in a box 80 to energize a reversible DC motor 82. The motor drives a winch spool 84 to either wind cable 86 onto the winch spool or to unwind cable from the spool. An accessory mounting stud 88 is fixed to the front side of the sleeve 68 and extends horizontally forward form the sleeve 68. A pair of vertical accessory retainer plates 89 are secured to the sleeve 68 above the mounting stud 88.

A mast extension 90 is telescopically received in the upper end 92 of the mast 60. A pin 94 passes through one of the transverse bores 64 and through one of a plurality of mast extension bores 96 through the mast extension 90 to hold the mast extension in a selected vertical position relative to the mast 60.

A grooved roller 98 is journaled on a horizontal pin 100 that passes through a yoke 102 fixed to the mast extension 90. The cable 86 extends from the winch spool 84 up to the grooved roller 98 and down to a hook 105 on the free end of the cable. The hook 105 engages the bottom of the sleeve 68 to support the winch assembly 66 when the pin 76 is removed. To change the vertical position of the winch assembly 66, the pin 76 is removed and the motor 82 drives the winch spool 84 in one direction to wind up cable 86 and raise the winch assembly and in a second direction to unwind cable and lower the winch assembly.

Figure 5:
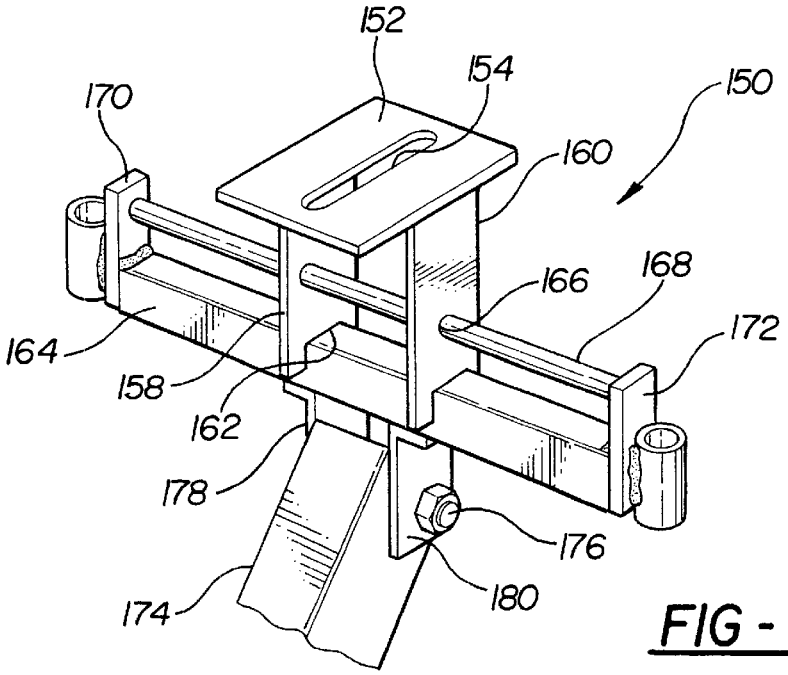
FIG. 5 is an enlarged perspective view of a portion of the hood supporting attachment.
Figure 6:
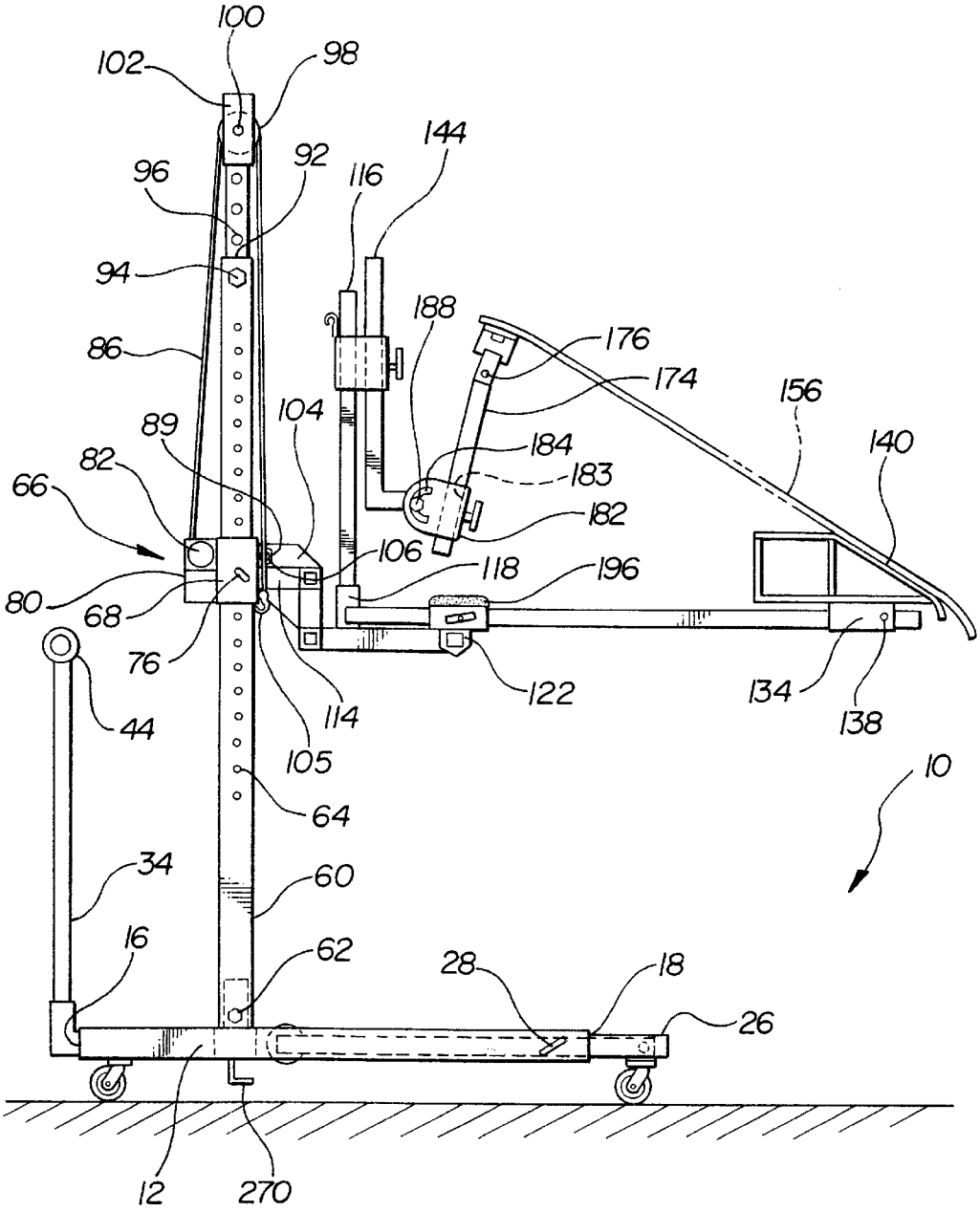
FIG. 6 is a side elevational view of the carriage with a mast and a hood on a hood supporting attachment.
Figure 7:
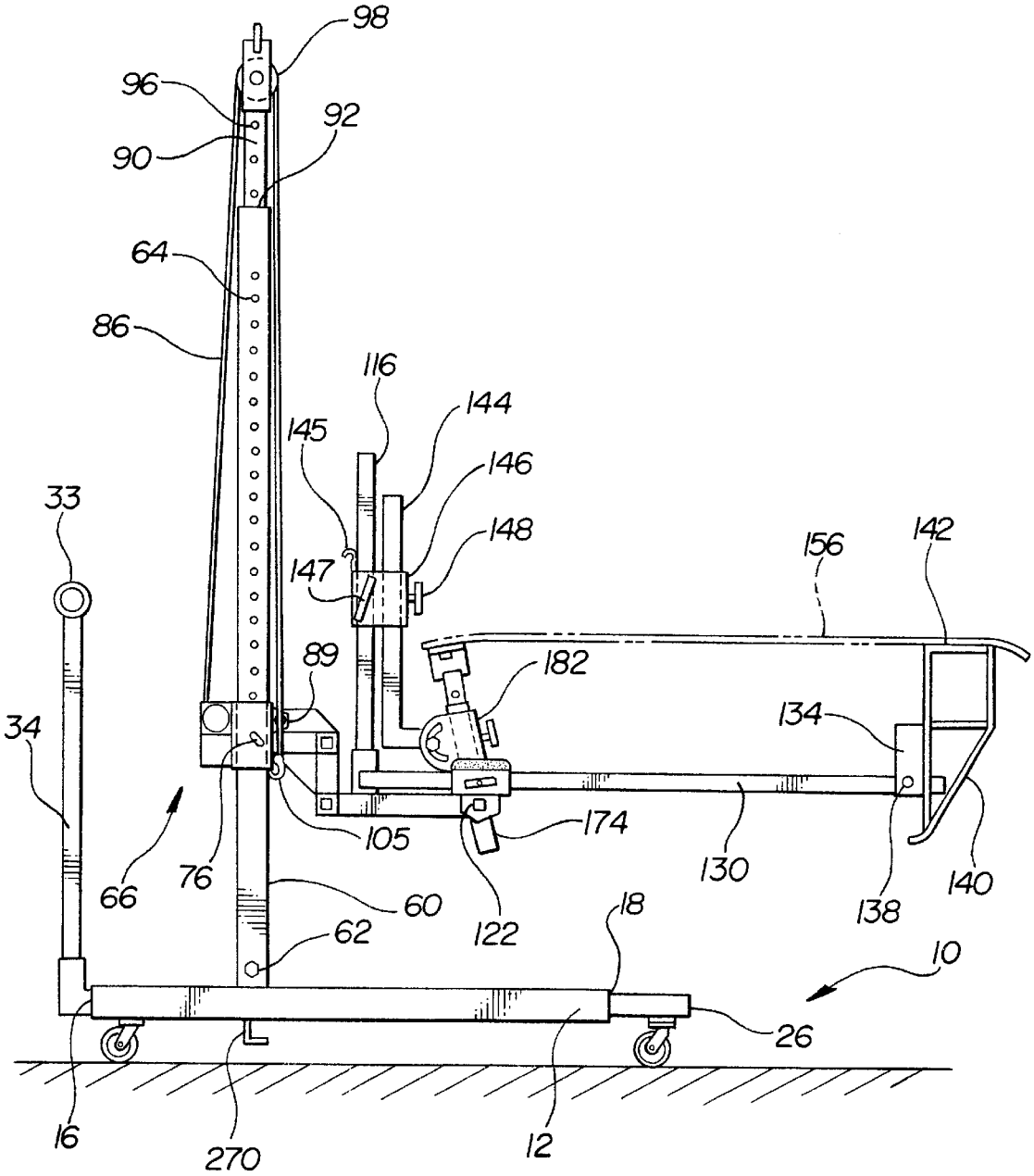
FIG. 7 is a view similar to FIG. 6 with the hood in a generally horizontal position for repair.

The hood removal and mounting accessory 110 is shown in FIGS. 4, 5, 6, and 7. This accessory has an accessory base 112 with a horizontal sleeve 114 that is telescopically received on the accessory mounting stud 88 of the winch assembly 66. A flat vertical plate 104 is welded to the horizontal sleeve 114 and is positioned between two retainer plates 89 as shown in FIG. 6. A bolt 106 passes through the two retainer plates 89 and the vertical plate 104 to retain the accessory base 112 on the stud 88. The plates 89 and 104 reduce bending loads on the stud 88 and can be used with all attachments to the stud. The accessory base 112 supports a vertical secondary mast bar 116 in a socket member 118 and a transverse horizontal beam 121. Another horizontal beam 120 is preferably forward of the socket member 118 some distance. Rectangular rods 122 are telescopically received in each end of the horizontal beam 120. Threaded T-clamps 124 hold the rods 122 in selected positions in the beam 120 and maintain a selected distance between the tubular member 126 and 128 fixed to the outboard ends of the rods 122. The tubular members 126 and 128 have horizontal fore and aft passages that telescopically receive fore and aft bars 130 and 132. Threaded T-clamps 133 are tightened to retain the bars 130 and 132 in selected positions. Hood support brackets 134 and 136 are pivotally attached to the forward ends of the bars 130 and 132 by pivot pins 138. These pins 138 permit the hood support brackets 134 and 136 to pivot between the position shown in FIG. 4 and 6 and the position shown in FIG. 7 as discussed below. Both support brackets 134 and 136 have angle hood support surfaces 140 and horizontal hood support surfaces 142. The hood support surface 142 is horizontal when in a use position as shown in FIG. 7. The surface 142 is in a vertical non-use position as shown in FIGS. 4 and 6.

An L-shaped bar 144 is secured to the vertical bar 116 by a channel member 146 and a threaded T-shaped clamp member 148. The clamp member 148 is loosened to vertically adjust the L-shaped bar 144 and tightened to hold the L-shaped bar in a selected vertical position. A hood retainer assembly 150 is secured to the lower forward end of the L-shaped bar 144, as shown in FIG. 5, and includes a flat plate 152 with a slot 154. The slot 154 receives a bolt that clamps the plate 152 to the hood latch support in the front of the hood 156. Two vertical plates 158 and 160 are welded to the plate 152. The free ends of the plates 158 and 160 have a channel-shaped recess 162 that receives a horizontal bar 164. Bores 166 through the plates 158 and 160 receives a round rod 168. This connection permits the flat plate 152 to slide along the length of the rod 168 and the horizontal bar 164. End caps 170 and 172 fix the rod 168 relative to the bar 164 and limit movement of the plate 152. The horizontal bar 164 is pivotally connected to a support tube 174 by a bolt 176 and two spaced apart L-shaped brackets 178 and 180 that are fixed to the horizontal bar 164. The support tube 174 is telescopically received in a passage 183 through a channel member 182 with two sector slots 184. A clamp bolt 186 holds the support tube 174 in a selected vertical position in the L-shaped bar 144. The sector slots 184 and the bolt 188 hold the support tube 174 in a chosen angle relative to the L-shaped bar 144.

A vehicle hood 156 is removed and remounted using the hood removing accessory 110 by first adjusting the space between the hood support brackets 134 and 136 to accommodate the particular hood 156 using the T clamps 124. The fore and aft positions of the hood support brackets 134 and 136 are adjusted to accommodate the length of the hood 156 by loosening the T clamps 133, sliding the fore and aft bars 130 and 132 in the tubular members and 126 and 128 to the desired positions and then tightening the T clamps to retain the fore and aft bars in the selected positions. The accessory 110 is then vertically positioned by the winch assembly 166 and the carriage is moved on the caster wheels 24 and 32 to place the angled hood support surfaces 140 against the inside hood surface near the hood rear edge 190. The flat plate 152 is moved into contact with the latch supporting surfaces at the front end of the hood 156 and clamped in place by a bolt that passes through the slot 154. It may be necessary to remove part of a latch assembly from the hood 156 to free a bolt hole for attachment of the plate 152. The hood hinges are unbolted either from the hood 156 or from the vehicle body. After the hood 156 is released from the vehicle, it can be raised by the winch 66 if necessary and moved away from the vehicle. The rear portion of the hood 156 is manually lifted to free the hood support brackets 134 and 136 to pivot 90° about the pivot pins 138. After the hood support brackets 134 and 136 have been pivoted to the positions shown in FIG. 7, the hood 156 is lowered onto the horizontal hood support surfaces 142. The flat plate 152 and the horizontal bar 164 pivot about the bolt 176 in response to raising and lowering the hood rear edge 190. The winch assembly 66 positions the hood 156 at desired elevations for hood repair if the hood has been damaged.

The pin 76 can be inserted through the sleeve 68 and a bore 64 through the mast to hold the winch 66 in a fixed position. The hook 105 on the cable 86 is attached to a hook receiver 145 on the channel member 146. A threaded T-clamp 147 is loosened and the channel member 146 can be moved vertically along the vertical mast 116 to vertically reposition the L-shaped bar 144 and the front of the hood 156. The channel member 146 is a tubular sleeve with two passages. One passage receives the L-shaped bar 144. The other passage telescopically receives the secondary mast 116. The passage in the channel member 146 that receives the secondary mast 116 preferably includes bearings that reduce friction when vertically moving the channel member along the secondary mast.

Figure 10:
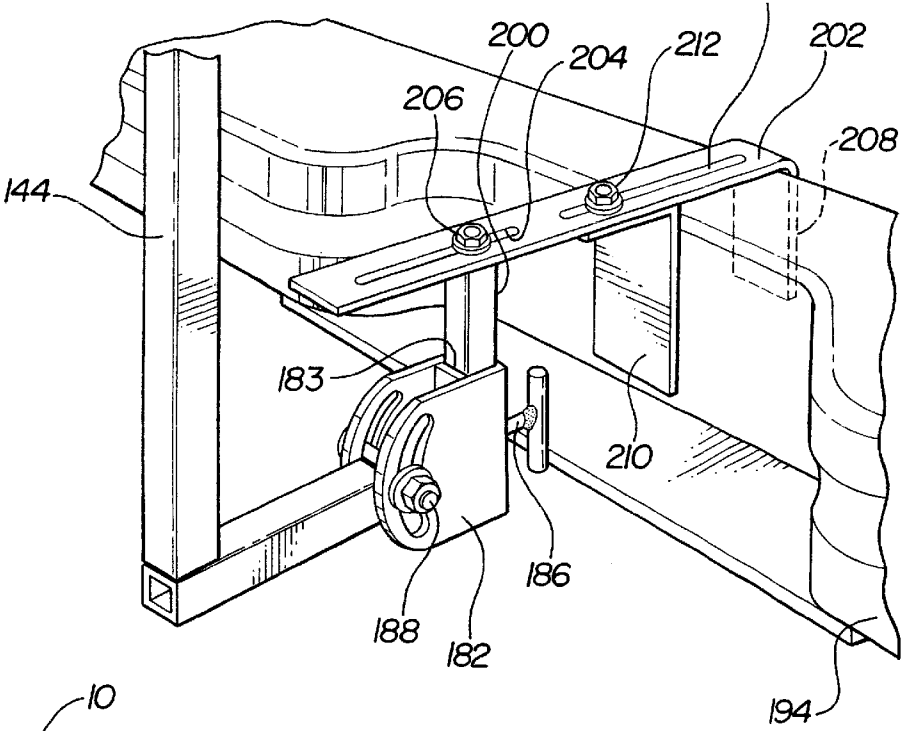
FIG. 10 is an enlarged perspective view of a portion of the bumper holding attachment.
Figure 9:
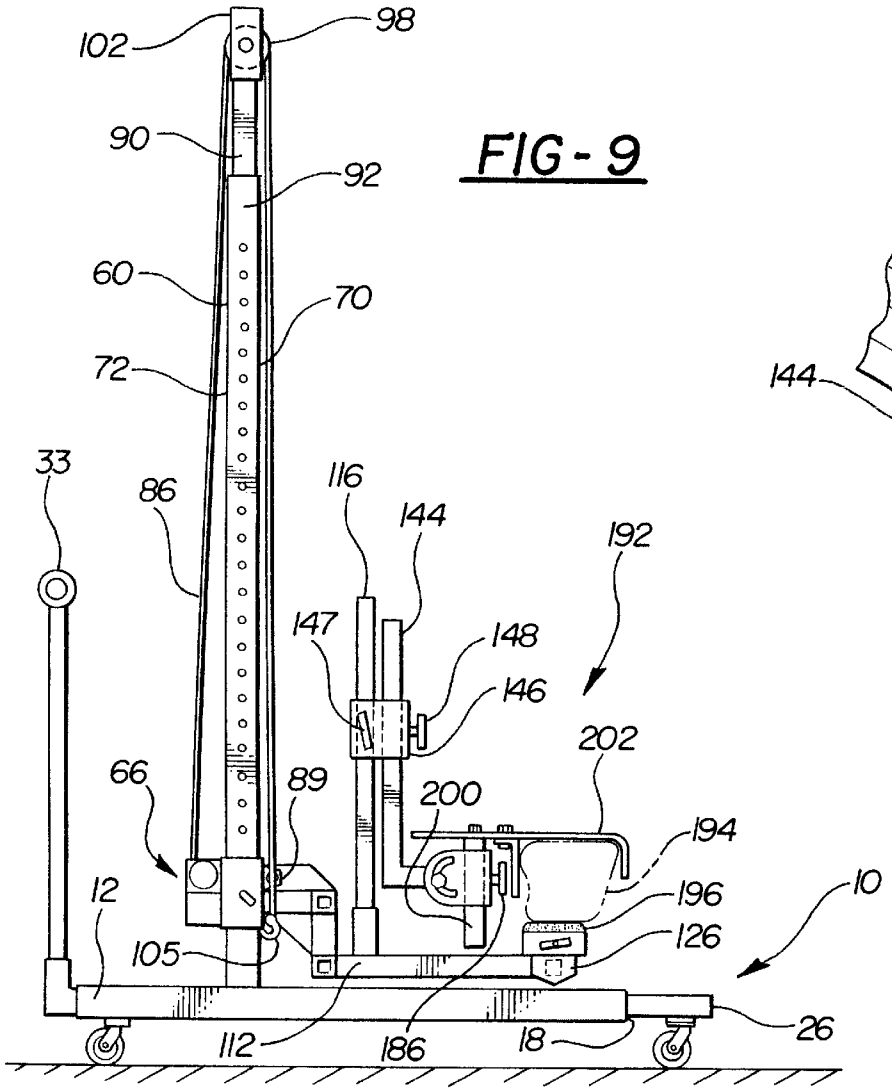
FIG. 9 is a side elevational view of the carriage assembly with a bumper holding attachment connected to the winch assembly.

A bumper removing and installation accessory 192 is shown in FIGS. 9 and 10. This accessory 192 employs the accessory base 112, the tubular members 126 and 128, the vertical bar 116 and the L-shaped bar 144 which were discussed above. The support tube 174 together with the remainder of the hood retainer assembly 150 and the fore and aft bars 130 and 132 are removed. A bumper 194 sits on the rubber pads 196 and 198 secured to the top of the tubular members 126 and 128. A bar 200 is clamped in a passage 183 through the channel member 182 by the clamp bolt 186 with a T handle. A bolt 188 holds the channel member 182 in a selected position on the L-shaped bar 144. A first bumper holder 202 with a first slot 204 is clamped to the bar 200 by a bolt 206. The first bumper holder 202 has an inner bumper positioning member 208 that contacts one side of the bumper 194. An upside-down L-shaped outer bumper holder 210 is clamped to the bumper holder 202 by a bolt 212 that passes through a slot 214. The bumper 194 is between the positioning member 208 and the holder 210 and held in an upright position on the rubber pads 196 and 198.

Bumpers 194 are designed with a variety of sizes and shapes. Some bumpers function as part of a trailer hitch and are as a result relatively heavy. Other bumpers are covered by a plastic shroud. The bar 200 can be inserted upward into the bottom of the passage 183 to permit the bumper accessory to hold a vehicle bumper from the bottom and up under a shroud or other structure that covers the top of the bumper.

During use of the bumper removing and installation accessory 192, to remove a bumper 194, the carriage 10 moves the rubber pads 196 and 198 under the bumper 194. The winch assembly 66 lifts the rubber pads 196 and 198 into contact with the bumper 194 by lifting the accessory base. The inner bumper positioning member 208 and the outer bumper holder 210 are moved into bumper holding positions and clamped in place. The bumper 194 is unbolted from the vehicle. The winch assembly 66 lowers the bumper 194 and then the carriage 10 together with the bumper is moved away from the vehicle. The above procedure is reversed to install a bumper 194.

Figure 8:
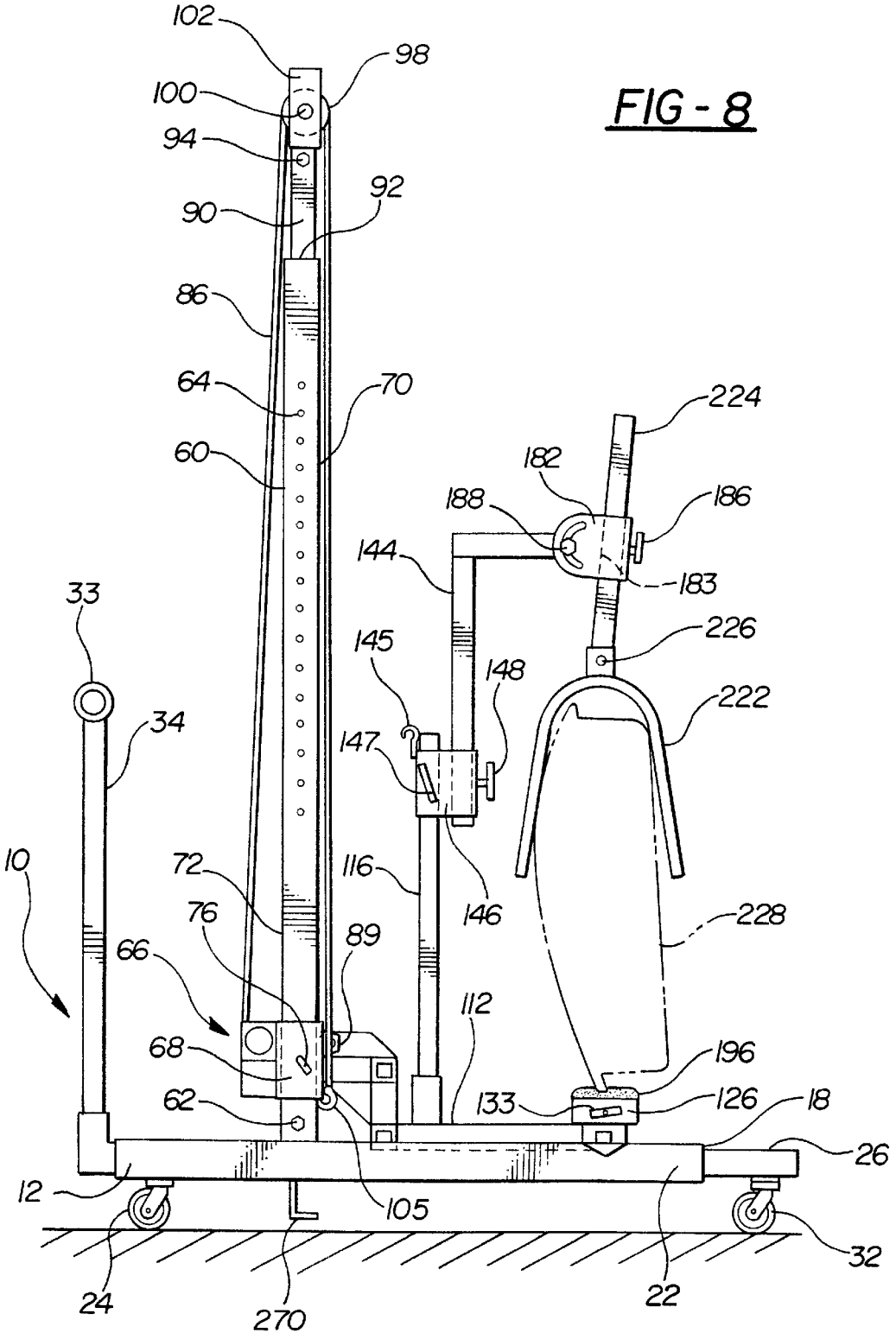
FIG. 8 is a side elevational view of the carriage with a door holding attachment connected to the winch assembly.

The door removal and mounting accessory 220 is shown in FIG. 8. The door accessory 220 uses the accessory base 112, the tubular members 126 and 128 with the rubber pads 196 and 198 and the vertical bar 116 as described above. The L-shaped bar 144 is also used but is turned upside down. A yoke member 222 with protective padding is clamped to a yoke retainer bar 224 by a bolt 226. The yoke retainer bar 224 is received in the passage 183 in the channel member 182 on the L-shaped bar 144. The L-shaped bar 144 is turned upside down and clamped to the vertical bar 116 described above.

The rubber pads 196 and 198 are raised up under a door 228 that is to be removed from a vehicle by the winch assembly 66 as shown in FIG. 8. The yoke member 222 is lowered over the top of the door and the clamp bolts 147, 148 and 186 with T-handles as well as the bolts 188 and 226 are tightened. The door 228 is then detached from the vehicle body and moved away together with the carriage 10. The procedure is reversed to reattach a door 228 to a vehicle. Retainers (not shown) can be attached to the tubular members 126 and 128 to catch the door 228 if it slides off the rubber pads 196 and 198.

Figures 13, 14:
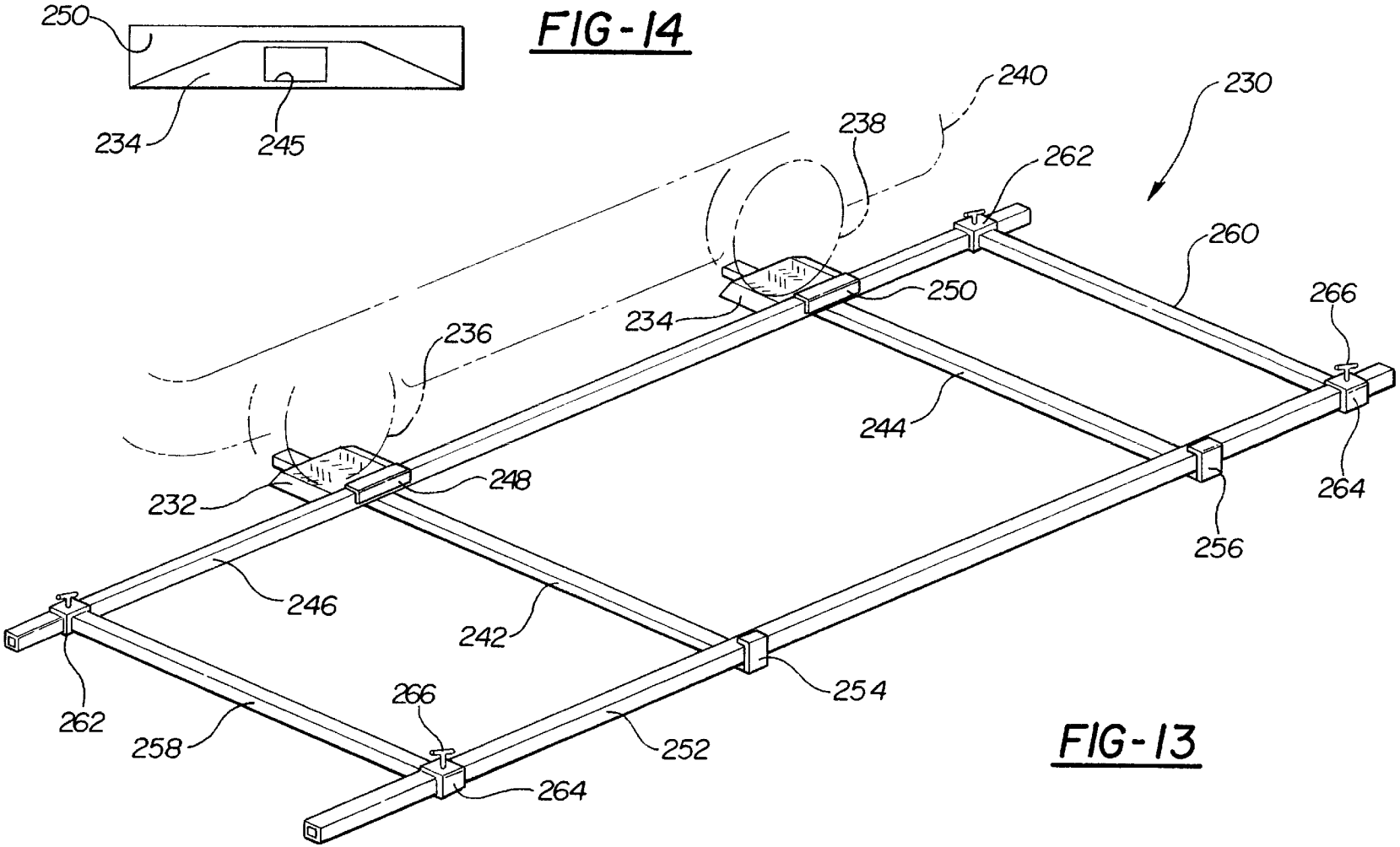
FIG. 13 is a perspective view of a carriage anchor system.
FIG. 14 is an enlarged elevational view of a vehicle support pad.

The carriage 10 is preferably relatively lightweight but strong so that it can be moved as required manually. When using the carriage 10 and the winch assembly 66, to remove dents from a vehicle, the carriage needs to be fixed. The carriage retainer 230 shown in FIG. 13 is used to anchor the carriage 10 in a fixed position. The carriage retainer 230 includes two vehicle support pads 232 and 234 that support two wheels 236 and 238 on one side of a vehicle 240. Retainer bars 242 and 244 slide through passages 245 through the support pads 232 and 234. An inside rectangular tube 246 sets on top of the retainer bars 242 and 244 and passes through channel members 248 and 250 that are welded to the support pads 232 and 234. An outside rectangular tube 252 sets on top of the retainer bars 242 and 244 and is received in upside down L-shaped retainers 254 and 256, that are welded to the retainer bars, to limit upward movement and outward movement of the outside rectangular tube relative to the inside rectangular tube 246. Cross bars 258 and 260 have tubular sleeves 262 and 264 welded to their ends. The tubular sleeves 262 and 264 telescopically receive the inside rectangular tube 246 and the outside rectangular tube 252 and hold the inside and outside rectangular tubes 246 and 252 parallel to each other. Threaded T-clamps 266 are screwed into the tubular sleeves 262 and 264 to hold the inside and outside tubes 246 and 252 in selected positions relative to the cross bars 258 and 260. Additional clamping bolts or pins can be added to fix components of the carriage retainer 230 relative to each other.

The caster wheels 24 and 32 hold the H-shaped main frame 22 up so that the carriage 10 can straddle the outside tube 252. Hook members 270 are welded to the transverse base beam 20 of the H-shaped main frame 22, and extend below the side beams 12 and 14. Open sides of the hook members 270 face toward the front. Movement of the carriage 10 toward the vehicle 240 results in the hook members 270 receiving the outside rectangular tube 252. The engagement between the hook members 270 and the outside rectangular tube 252 limit movement of the carriage 10 toward the vehicle 240 and limit upward movement of the rear caster wheels 24. Limiting upward movement of the rear caster wheels 24 tends to hold the tubular mast 60 in a substantially vertical position.

Dents 271 are pulled from the side of the vehicle 240 by moving the carriage 10 toward the vehicle until the hook members 270 receive the outside rectangular tube 252. The winch assembly 66 is moved on the mast 60 until the accessory mounting stud 88 is about the same height of the dent 271. A cable pulley accessory 272 includes a tubular sleeve 274 that is telescopically received on the mounting stud 88. A bolt 276 passes through retainer plates 89 and a flat vertical plate 277 welded to the sleeve 274 and retains the pulley accessory 272 on the stud 88. A pin 76 is inserted through the tubular sleeve 68 and one of the bores 64 to hold the winch assembly 66 at the desired elevation. Cable 86 is unwound from the winch spool 84, the hook 105 and the cable are routed under the cable guide pulley 278, and the hook engages a holder 280 welded to the vehicle 240 and the dent 271. The holder 280 can be a sheet metal piece, with a hook engaging aperture, and an edge welded to the dented metal. The cable 86 is then wound up on the winch spool 84 to pull a dent 271 out. The hook 105 is released from the holder 280. The next step for repairing the dent 271 is to grind the holder 280 off and prepare the damaged area to receive body putty.

To remove a dent 281 from the top 282 of a vehicle 240 a lifting attachment 284 is required. The lifting attachment 284 has a tubular arm 285 that can telescopically receive the accessory mounting stud 88. An inner guide pulley 286 is journaled above the inboard end of the tubular arm 285. An outboard pulley 288 is journaled on the outboard end of the tubular arm 285 and above the tubular arm. The tubular arm 285 includes a bar 283 that is telescopically received in a tubular beam 287. A threaded T-clamp 289 clamps the bar 283 relative to a tubular beam 287. Adjustment of the length of the arm 285 positions the pulley 288 above a sheet metal holder 290. The cable 86 passes under the inner guide pulley 286 and over the outboard pulley 288. The hook 105 is attached to a sheet metal holder 290 welded to the dented metal in the dent 281. For large dents 281 more than one holder 290 may be required. The cable 86 is wound onto the winch spool 84 to pull the dented metal 281 back toward the original position it occupied. The hook 105 is then released form the holder 290 and repair of the dent 281 proceeds as explained above.

Figure 12:
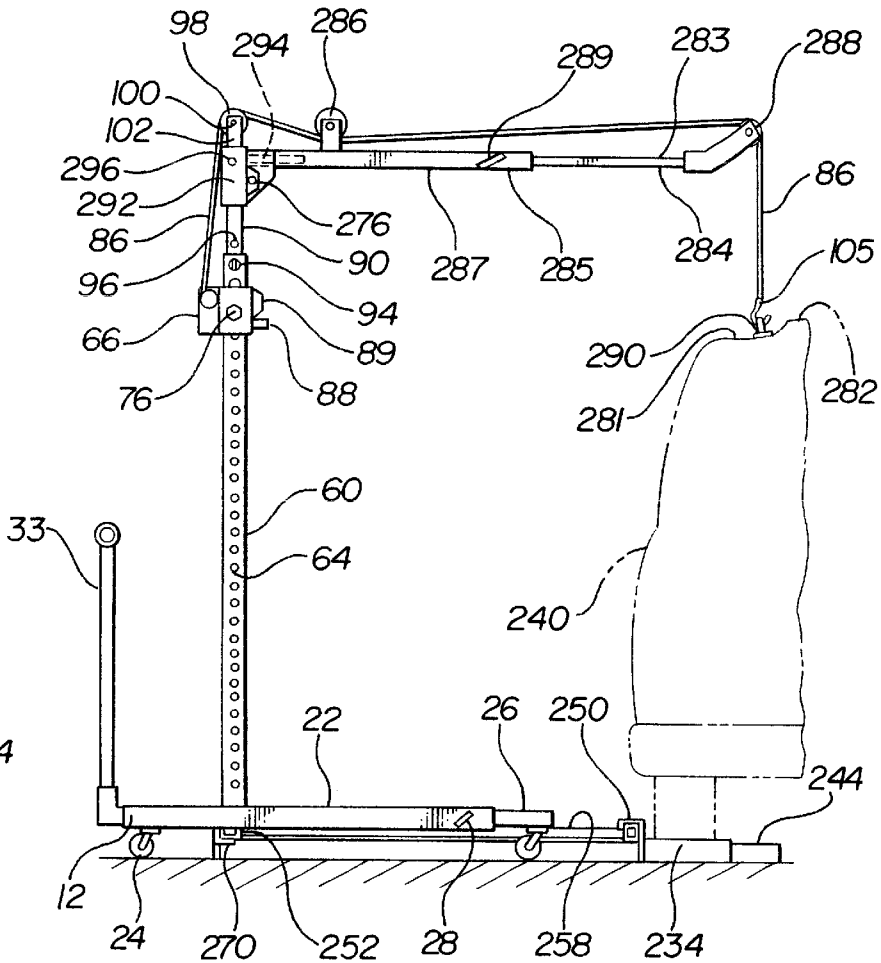
FIG. 12 is a side elevational view of the carriage with a mast and the winch pulling a dent vertically from a vehicle.
Figure 11:
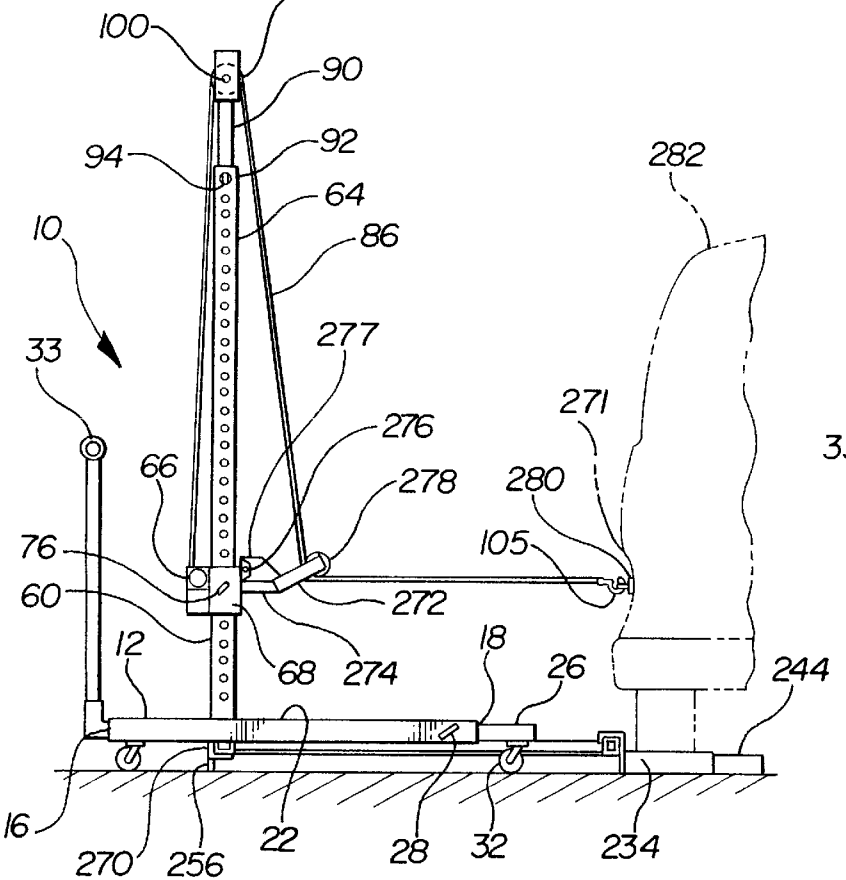
FIG. 11 is a side elevational view of the carriage with a mast and the winch pulling a dent horizontally from a vehicle.

Removal of the dent 281 as explained above works only if the mast 60 is sufficiently high to move the winch assembly 66 well above the dent 281. When the dent 281 is too high as shown in FIG. 12, the mast extension must be used. The mast extension 90 is too small to guide the tubular sleeve 68 of the winch assembly 66. It is therefore necessary to attach a small tubular sleeve 292 to the mast extension 90. The small sleeve 292 has an accessory mounting stud 294 that telescopically receives the tubular arm 285 like the mounting stud 88 described above. A pin 276 holds the beam 287 on the stud 294. The small mounting sleeve 292 is pinned to the mast extension 90 by a pin 296 that passes through a mast extension bore 96. The winch assembly 66 is held in a selected position by a pin 76 and the cable 86 is routed over the grooved roller 98, under the guide pulley 286, over the outboard pulley 288 and down to the holder 290. The cable 86 is wound onto the winch spool 84 to pull the dented metal 281 back toward the original position.

The carriage 10 can be used to perform many tasks in addition to the examples given above. A trunk lid can be mounted and removed like the hood 156. The box of a pick-up truck can be mounted or removed by lifting the rear of the box with the accessory base 112 and the rubber pads 196 and 198. After the tubular sleeve 68 is locked by the pin 76 in a position that supports the rear of the box in a raised position, the hook 105 is connected to the front of the box and the cable 86 is taken up by the winch 66 and the box is lifted from the pick-up frame. Since the retainer 230 is not used to anchor the carriage 10, the first and second main frame support tubes 26 and 30 must be extended to lift a truck box from the rear. The mast 60 and the mast mounting stud 58 can be reinforced, for lifting a truck box with a center of gravity located several feet horizontally from the mast, by attaching struts or tension cables to an upper portion of the mast and to the rear ends 16 of the first and second side beams 12 and 14. Additional tasks will become obvious during use of the tool described above.

The disclosed embodiment is representative of a presently preferred form of the invention, but is intended to be illustrative rather than definitive thereof. The invention is defined in the claims.

I claim:

1. A vehicle body repair tool comprising:

a carriage having a main frame, a plurality of wheels attached to and supporting the main frame and a mast mounting structure on the main frame;

a mast connected to the mast mounting structure and extending generally vertically upward from said carriage;

a first tubular sleeve slideably mounted on the mast and vertically movable relative to the mast;

a winch assembly fixed to the first tubular sleeve;

an accessory mount on the first tubular sleeve;

a mast roller mounted on top of the mast;

a winch cable extending upward, over the mast roller and having an end hook that is connectable to the first tubular sleeve and wherein the winch assembly is operable to move the first tubular sleeve vertically along the mast;

a first sleeve retainer for holding the first tubular sleeve in a selected vertical position on the mast and freeing the winch cable and the end hook; and an accessory attached to the accessory mount on the first tubular sleeve.

2. A vehicle body repair tool as set forth in claim 1 wherein the accessory attached to the accessory mount is a vehicle hood support and holder.

3. A vehicle body repair tool as set forth in claim 1 wherein the accessory attached to the accessory mount is a vehicle bumper support for supporting a vehicle bumper during installation and removal.

4. A vehicle body repair tool as set forth in claim 1 wherein the accessory attached to the accessory mount is a vehicle door holder for holding a door during removal, repair and installation.

5. A vehicle body repair tool as set forth in claim 1 wherein the accessory attached to the accessory mount is a cable pulley accessory with a pulley that routs the winch cable horizontally for pulling vehicle body panels generally horizontally.

6. A vehicle body repair tool as set forth in claim 1 wherein the accessory attached to the accessory mount is a lifting attachment with at least one outboard pulley on an outboard end of an arm that routs the winch cable vertically for pulling body panels generally vertically.

7. A vehicle body repair tool as set forth in claim 1 including a mast extension attached to said mast and extending vertically upward from said mast and wherein the mast roller is journaled on the mast extension;

an extension mast sleeve telescopically received on the mast extension and positioned in a selected position on the mast extension by a sleeve pin, and a sleeve accessory mounting stud integral with the extension mast sleeve; and a lifting attachment arm mounted on the sleeve accessory mounting stud with at least one outboard pulley on an outboard end of the lifting attachment arm and wherein the winch cable extends generally vertically downward from the at least one outboard pulley for pulling body panels generally vertically upward.

8. A vehicle body repair tool as set forth in claim 1 including a retainer assembly with at least one vehicle support pad, an anchor tube connected to the at lest one vehicle support pad, and a hook member integral with the carriage main frame and engageable with the anchor tube to limit vertical and horizontal movement of the carriage main frame.

9. A vehicle body repair tool as set forth in claim 1 wherein the accessory includes an accessory base attached to the accessory mount, a vertical secondary mast bar attached to the accessory base, a channel member slideably mounted on the vertical secondary mast, at least one workpiece support holder on the channel member mounted on the vertical secondary mast and at least one workpiece support holder on the accessory base.

10. A vehicle body repair tool as set forth in claim 9 wherein the at lest one workpiece support holder on the channel member mounted on the vertical secondary mast is a hood retainer assembly and the at least one workpiece support holder on the accessory base includes two tubular members adjustably connected to a horizontal beam of the accessory base.

11. A vehicle body repair tool as set forth in claim 1 wherein the winch assembly is powered by a reversible motor.

12. A vehicle body repair tool as set forth in claim 11 wherein the reversible motor is energized by a battery carried on the carriage.

13. A vehicle body repair tool comprising:

a carriage retainer with a front wheel support pad, a rear wheel support pad, a front retainer bar anchored to the front wheel support pad, a rear retainer bar anchored to the rear wheel support pad, and an outside tube held in a horizontal position by the front retainer bar and the rear retainer bar;

a carriage having a main frame supported by a plurality of carriage support wheels and at least one hook member integral with the main frame and engageable with the outside tube of the carriage retainer to limit horizontal movement of the carriage toward the front and rear wheel support pads and to limit upward movement of the carriage;

a generally vertical mast mounted on the main frame of the carriage;

a tubular sleeve with an accessory mount, slideably mounted on the mast in one of a plurality of positions and anchored on the generally vertical mast;

a winch assembly attached to the generally vertical mast and a cable connected to a winch spool of the winch assembly and having a free cable end that extends up and over a grooved roller journaled on the generally vertical mast;

and one or more rollers attached to the accessory mount that guide the free cable end and control the direction that force is exerted on a vehicle component connected to the free cable end in response to tension exerted on the cable by the winch spool.

14. A vehicle body repair tool as set forth in claim 13 wherein the winch assembly is attached to the tubular sleeve and slides relative to the generally vertical mast together with the tubular sleeve.

15. A vehicle body repair tool as set forth in claim 13 wherein the one or more rollers attached to the accessory mount, that guide the free cable end, guide the cable to exert a generally horizontal force.

16. A vehicle body repair tool as set forth in claim 13 wherein the one or more rollers attached to the accessory mount, that guide the free cable end, guide the cable to exert a generally vertical force.

17. A vehicle body repair tool comprising:

a carriage having a main frame supported by a plurality of carriage support wheels;

a generally vertical mast attached to the main frame of the carriage;

a tubular sleeve, with an accessory mount, slideably mounted on the generally vertical mast and anchorable on the generally vertical mast in one of a plurality of positions;

an accessory base connected to the accessory mount;

a plurality of vehicle component supports attached to the accessory base and wherein the plurality of vehicle component supports includes at least one horizontally adjustable vehicle component support that is horizontally adjustable relative to the accessory base, and at least one vertically adjustable vehicle component support that is vertically adjustable relative to the accessory base; and a power lift for moving the tubular sleeve relative to the generally vertical mast.

18. A vehicle body repair tool as set forth in claim 17 wherein the power lift for moving the tubular sleeve is a winch assembly.

19. A vehicle body repair tool as set forth in claim 18 wherein the winch assembly is mounted on the tubular sleeve and a cable of the winch assembly passes over a roller journaled on the top of the generally vertical mast and has a free cable end that is attached to the tubular sleeve.

20. A vehicle body repair tool as set forth in claim 17 wherein the at least one vertically adjustable vehicle component support is connected to a secondary sleeve that is slideably received on a secondary mast bar attached to the accessory base.

21. A vehicle body repair tool as set forth in claim 20 wherein the secondary sleeve is connected to the power lift and moved along the secondary mast bar by the power lift.

22. A method of repairing a vehicle body comprising moving a carriage, having a carriage frame, a generally vertical mast attached to the carriage frame, a tubular sleeve telescopically received on the generally vertical mast and fixable in any one of a plurality of vertical positions, to a working position relative to a vehicle body that is to be repaired;

adjusting the vertical height of the tubular sleeve;

attaching at least one cable routing roller to the tubular sleeve;

routing a winch cable over a grooved roller journaled directly on an upper end of the generally vertical mast, around the at least one cable routing roller and attaching a free end of the winch cable to a vehicle component;

anchoring the carriage in a selected position; and applying tension to the winch cable.

23. A vehicle body repair tool comprising:

a carriage having a main frame, a plurality of wheels attached to and supporting the main frame and a mast mounting structure on the main frame;

a mast connected to the mast mounting structure and extending generally vertically upward from said carriage;

a first tubular sleeve slideably mounted on the mast and vertically movable relative to the mast;

a winch assembly fixed to the first tubular sleeve;

an accessory mount on the first tubular sleeve;

a mast roller mounted on top of the mast;

a winch cable extending upward, over the mast roller and having an end hook that is connectable to the first tubular sleeve and wherein the winch assembly is operable to move the first tubular sleeve vertically along the mast;

a first sleeve retainer for holding the first tubular sleeve in a selected vertical position on the mast and freeing the winch cable and the end hook;

an accessory attached to the accessory mount on the first tubular sleeve;

a mast extension attached to said mast and extending vertically upward from said mast and wherein the mast roller is journaled on the mast extension;

an extension mast sleeve telescopically received on the mast extension and positioned in a selected position on the mast extension by a sleeve pin, and a sleeve accessory mounting stud integral with the extension mast sleeve; and a lifting attachment arm mounted on the sleeve accessory mounting stud with at least one outboard pulley on an outboard end of the lifting attachment arm and wherein the winch cable extends generally vertically downward from the at least one outboard pulley for pulling body panels generally vertically upward.

* * * * *